US011549356B2

(12) United States Patent
Mittal et al.

(10) Patent No.: US 11,549,356 B2
(45) Date of Patent: Jan. 10, 2023

(54) EFFECT OF HOLE CLEANING ON TORQUE AND DRAG

(71) Applicant: Landmark Graphics Corporation, Houston, TX (US)

(72) Inventors: Manish Kumar Mittal, Cypress, TX (US); Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 17/135,231

(22) Filed: Dec. 28, 2020

(65) Prior Publication Data

US 2022/0205352 A1 Jun. 30, 2022

(51) Int. Cl.

| | |
|---|---|
| ***E21B 44/02*** | (2006.01) |
| ***E21B 37/00*** | (2006.01) |
| ***E21B 49/00*** | (2006.01) |
| ***E21B 45/00*** | (2006.01) |
| ***E21B 21/08*** | (2006.01) |
| ***E21B 7/04*** | (2006.01) |

(52) U.S. Cl.

CPC ..... *E21B 44/02* (2013.01); *E21B 21/08* (2013.01); *E21B 37/00* (2013.01); *E21B 45/00* (2013.01); *E21B 49/003* (2013.01); *E21B 7/04* (2013.01)

(58) Field of Classification Search

CPC ..... E21B 44/02; E21B 21/08; E21B 37/00; E21B 45/00; E21B 49/003; E21B 7/04

See application file for complete search history.

(56) References Cited

U.S. PATENT DOCUMENTS

| | | | | |
|---|---|---|---|---|
| 4,760,735 | A | 8/1988 | Sheppard et al. | |
| 5,044,198 | A | 9/1991 | Ho | |
| 8,443,883 | B2 | 5/2013 | Peter et al. | |
| 2009/0159333 | A1 | 6/2009 | Guidry et al. | |
| 2014/0116776 | A1* | 5/2014 | Marx | G06N 5/02 706/11 |
| 2015/0134257 | A1 | 5/2015 | Erge et al. | |
| 2017/0098020 | A1 | 4/2017 | Samuel et al. | |
| 2018/0305989 | A1* | 10/2018 | Oyedokun | E21B 17/20 |
| 2021/0140274 | A1* | 5/2021 | Forshaw | E21B 37/00 |

* cited by examiner

*Primary Examiner* — Dany E Akakpo

(74) *Attorney, Agent, or Firm* — Benjamin Ford; Parker Justiss, P.C.

(57) ABSTRACT

The disclosure presents processes and methods for determining an adjusted drag friction factor, where the adjusting utilizes a hole cleaning function. In some aspects, the drag friction factor utilizes viscous drag. In some aspects, the drag friction factor utilizes viscous torque. In some aspects, the drag friction factor can be utilized to determine one or more decomposed friction factors. The decomposed friction factors or the adjusted drag friction factor can be utilized in a friction processor to improve the efficiency of borehole operations. The hole cleaning function can utilize various parameters, for example, a cuttings density, a cuttings load, a cuttings shape, a cuttings size, a deviation, a drill pipe rotation rate, a drill pipe size, a flow regime, a hole size, a mud density, a mud rheology, a mud velocity, a pipe eccentricity, and other parameters. A system is disclosed that is capable of implementing the processes and methods.

20 Claims, 5 Drawing Sheets

EFFECT OF HOLE CLEANING ON TORQUE AND DRAG

TECHNICAL FIELD

This application is directed, in general, to improving borehole operation efficiency and, more specifically, to analyzing hole cleaning operations on drag and torque components of friction.

BACKGROUND

In developing a borehole, there can be many factors affecting borehole operations, such as friction, the factors related to friction, and borehole cleaning. Friction can affect the wear of equipment, alter the characteristics of the surrounding formation of the borehole while decreasing borehole operation efficiency. Borehole cleaning can affect friction as well as affecting the ability to trip out a drill string. It would be beneficial to be able to improve the accuracy of torque and drag predictions including the effect of hole-cleaning, applied to a portion of the borehole to improve the operational efficiency of borehole operations.

SUMMARY

In one aspect, a method to determine a hole cleaning friction factor for a borehole operation is disclosed. In one embodiment, the method includes (1) receiving drilling sensor data, wherein the drilling sensor data includes input parameters and hole cleaning parameters, (2) calculating a drag factor using the drilling sensor data, and (3) generating one or more hole cleaning friction factors utilizing the drag factor and the drilling sensor data, wherein the hole cleaning friction factor applies to a portion of a borehole undergoing the borehole operation, and the drag factor is adjusted by a hole cleaning function.

In a second aspect, a system to adjust a borehole operation utilizing a hole cleaning friction factor is disclosed. In one embodiment, the system includes (1) a data transceiver, capable of receiving input parameters, drilling sensor data, and hole cleaning parameters from one or more of downhole sensors, surface sensors, a data store, a previous survey data, a well site controller, or a computing system, (2) a result transceiver, capable of communicating a generated hole cleaning friction factor and one or more decomposed hole cleaning friction factors to a borehole operation system, and (3) a hole cleaning processor, capable of using the hole cleaning parameters and the input parameters to generate one or more hole cleaning friction factors utilizing a hole cleaning function.

In a third aspect, a computer program product having a series of operating instructions stored on a non-transitory computer-readable medium that directs a data processing apparatus when executed thereby to perform operations to determine a hole cleaning friction factor for a borehole operation is disclosed. In one embodiment, the computer program product has operations including (1) receiving drilling sensor data, wherein the drilling sensor data includes input parameters and hole cleaning parameters, (2) calculating a drag factor using the drilling sensor data, and (3) generating one or more hole cleaning friction factors utilizing the drag factor and the drilling sensor data, wherein the hole cleaning friction factor applies to a portion of a borehole undergoing the borehole operation, and the drag factor is adjusted by a hole cleaning function.

BRIEF DESCRIPTION

Reference is now made to the following descriptions taken in conjunction with the accompanying drawings, in which.

DETAILED DESCRIPTION

Figure 1:
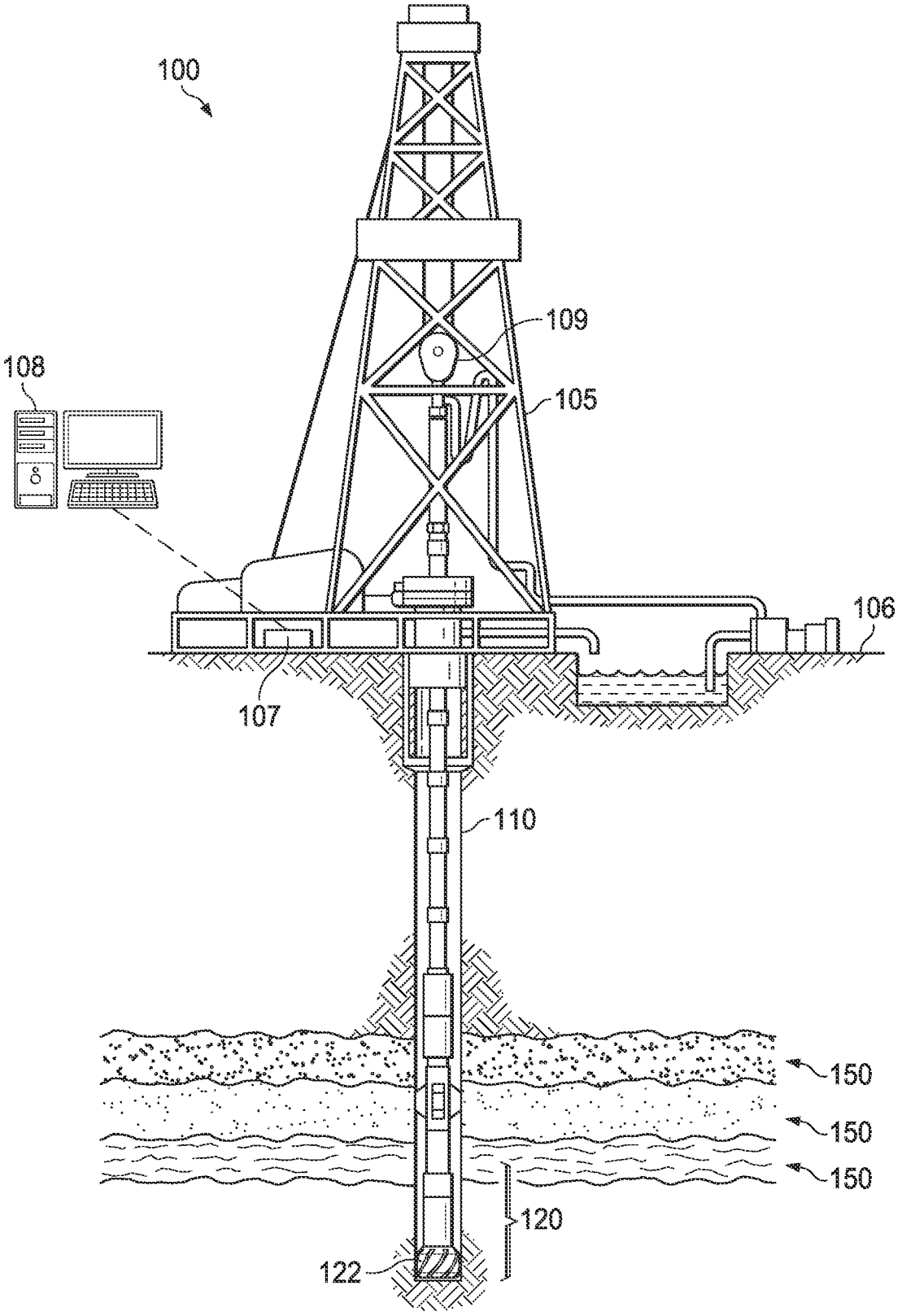
FIG. 1 is an illustration of a diagram of an example drilling borehole system computing borehole cleaning factors.

When developing a borehole, one or more types of borehole operations can be employed, such as drilling, trip in, trip out, extraction, and other borehole operations. Borehole operations can be affected by friction and accumulation of material in the borehole in one or more portions of the borehole. For example, a drilling fluid can accumulate cuttings and thereby increase the friction force against a rotating drill pipe, or the drill pipe can experience friction against a casing or subterranean formation, such as in a bend or dogleg portion of the borehole. A borehole can be developed for hydrocarbon production purposes, scientific purposes, or for other purposes that have operations occurring within a borehole.

Conventionally, the friction force can be estimated as a single friction coefficient, e.g., single friction factor, for a particular portion of the borehole. In some aspect, the portion of the borehole can be determined as the portion extending from a first survey station to a second survey station. In some aspects, such as in continuous survey operations, the portion can be determined as a certain number of feet, for example, forty feet or other length values. The contributing friction factors are not typically utilized for estimation purposes when a borehole is designed or drilled and completed in real-time or near real-time. One contributing factor, hole cleaning, can be utilized as a friction factor toward generating an overall friction factor for the analyzed portion of the borehole.

Poor hole cleaning can lead to a build-up of a cuttings bed on the lateral and horizontal portions of the borehole. The cuttings bed can increase the viscous drag on a drill pipe, e.g., a section of the drill string, that can lead to increased torque and drag. The increase in torque and drag can result in an inefficient drilling operation, a reduced rate of penetration, a pipe sticking issue, or other borehole operation issues and inefficiencies. The amount of the effect of the cuttings bed on the torque and drag components is typically not known.

This disclosure presents processes and methods to improve the accuracy of estimating the hole cleaning friction factor, thereby providing higher quality information to other systems and users which can be subsequently used to improve the efficiency of the borehole operations. The hole cleaning friction factor can be one or more factors or parameters representing the effect of a hole cleaning operation on the friction factors associated with borehole cuttings. The friction factor can be decomposed into different associated friction factors where one of the factors can include the effect of hole-cleaning. In some aspects, a commercial advantage can be achieved by improving the accuracy of the torque and drag factors as part of an engineering model. In some aspects, an improvement can be made to the estimations of the effect of the hole cleaning operations on hook-load and torque for various borehole operations, for example, tripping in, tripping out, rotating on the bottom, rotating off the bottom, and other borehole operations.

Estimating the components separately from other friction factors can improve the accuracy of the resulting combined, i.e., calculated, friction factor. In some aspects, each decomposed component can be analyzed independent of the other decomposed components to determine which one or more decomposed components are driving a deviation from a calibration function. Adjustments can be made to the borehole operations to reduce the one or more identified decomposed components effect on the operations.

Knowing more details about the components of the hole cleaning friction factor can provide better information to the borehole system or user to improve borehole operational efficiency. The components can be communicated as inputs into systems to determine specific adjustments to the borehole operations and to improve estimations on wear and tear of downhole equipment. For example, the composition of drilling fluid can be adjusted, a pump out operation can be scheduled, rotational speed of the drill string can be adjusted, and other adjustments can be made. In some aspects, the system using the friction factors can be a downhole system, for example, a bottom hole assembly (BHA), a drilling system, a geo-steering system, and other downhole systems. In some aspects, the system using the friction factors can be a surface or near surface system, such as a well site controller or a surface computing system. A user can be a borehole engineer, operator, or another type of user.

In some aspects, the analysis can be conducted in real-time or near real-time. In some aspects, the described processes can be used to estimate the sustainability during the life of the borehole. In some aspects, the described processes can be used in real-time or near real-time to adjust the drilling parameters or the borehole operation plan. In some aspects, the described processes can be used to predict problems or issues prior to being encountered by the borehole operation.

Generally, the hole cleaning friction factor can be computed from the decomposed factors of torque and drag. The axial drag on a drill pipe at a specific location within the borehole that can affect the hook-load is shown by example in Equation 1.

Example axial drag on a drill pipe — Equation 1

$$Drag_{ViscousDrag} = \text{friction factor} * \text{bouyed weight of drill pipe} * \text{velocity ratio} + \text{viscous drag}$$

The torsional, i.e., radial, drag on a drill pipe at a specific location within the borehole that can affect the frictional torque on the drill pipe is shown by example Equation 2.

Example radial drag on a drill pipe — Equation 2

-continued $$Drag_{ViscousTorque} = \text{friction factor} * \text{bouyed weight of drill pipe} * \text{drill pipe radius} * \text{velocity ratio} + \text{viscous torque}$$

The calculated $Drag_{ViscousDrag}$ and $Drag_{ViscousTorque}$ components can be represented by a respective $Drag_x$ component. A revised $Drag_x$ component is shown by example in Equation 3 where the result of a hole cleaning function is applied to the respective $Drag_x$ component calculated in Equation 1 or Equation 2.

Example New $Drag_x$ component including a hole cleaning function — Equation 3

$$\text{New } Drag_x = Drag_x * (1 + f(\text{hole cleaning}))$$

Where f(hole cleaning) is a function that models one or more factors of a hole cleaning operation and cuttings bed at the location of the borehole being analyzed. The hole cleaning function utilizes an algorithm that predicts the critical, e.g., minimum, annular velocities, e.g., flow rates, to remove or prevent a formation of cuttings beds or stationary cuttings during a directional drilling operation. The forces acting on the cuttings and its associated dimensional groups can be analyzed to determine the hole cleaning function. The hole cleaning function can be verified and calibrated against data collected during one or more field operations.

The hole cleaning function can evaluate one or more parameters on the cuttings transport. For example, the parameters can include, but are not limited to, a cuttings density, a cuttings load, e.g., a rate of penetration (ROP), a cuttings shape, a cuttings size, a deviation, a drill pipe rotation rate, a drill pipe size, a flow regime, a hole size, a mud density, a mud rheology, a mud velocity, e.g., a flow rate, a pipe eccentricity, and other parameters. The f(hole cleaning) can be expressed as shown by example in Equation 4.

Example expression of $f$(hole cleaning) — Equation 4

$$f(\text{hole cleaning}) = f(\text{cuttings density, cuttings load, cuttings shape, cuttings size, deviation, drill pip rotation rate, drill pipe size, flow regime, hople size, mud density, mud rheology, mud velocity, and pipe eccentricity})$$

In some aspects, Equation 4 can be expanded to include more than one type of cutting, such as cuttings from more than one type of subterranean formation, mineralogy, or more than one type of shape, size, or composition. For example, quartz, shale, and other types of cuttings can be present, where each type of cutting can exhibit differing characteristics, represented by a separate set of hole cleaning parameters. The equations can be rearranged so that the hole cleaning function can be used to determine one or more hole cleaning friction factors, which in turn can be used in a decomposed friction factor algorithm. Equation 5 shows an example hole cleaning drag and hole cleaning torque decomposed friction factors that can be utilized in a friction factor algorithm.

Example decomposed friction factor for hole cleaning drag and hole cleaning torque effects — Equation 5

$$FrictionFactor_{ViscousDrag} = \frac{\frac{Drag_D}{(1 + f(\text{hole cleaning})} - \text{viscous drag}}{\text{bouyed weight of drill pip} * \text{velocity ratio}}$$

$$FrictionFactor_{ViscousTorque} = \frac{\frac{Drag_T}{(1 + f(\text{hole cleaning})} - \text{viscous torque}}{\text{bouyed weight of drill pip} * \text{drill pipe radius} * \text{velocity ratio}}$$

Turning now to the figures, FIG. 1 is an illustration of a diagram of an example drilling borehole system 100 computing borehole cleaning factors. Drilling borehole system 100 can be a drilling system, a logging while drilling (LWD) system, a measuring while drilling (MWD) system, a seismic while drilling (SWD) system, a telemetry while drilling (TWD) system, and other hydrocarbon well systems, such as a relief well or an intercept well. Drilling borehole system 100 includes a derrick 105, a well site controller 107, and a computing system 108. Well site controller 107 includes a processor and a memory and is configured to direct operation of drilling borehole system 100. Derrick 105 is located at a surface 106.

Derrick 105 includes a traveling block 109 that includes a drill string hook. Traveling block 109 includes surface sensors to collect data on hook-load and torque experienced at traveling block 109. Extending below derrick 105 is a borehole 110 with downhole tools 120 at the end of a drill string. Downhole tools 120 can include various downhole tools and BHA, such as drilling bit 122. Other components of downhole tools 120 can be present, such as a local power supply (e.g., generators, batteries, or capacitors), telemetry systems, downhole sensors, transceivers, and control systems. The various sensors can be one or more of one or more downhole sensors or one or more surface sensors that can provide one or more hole cleaning parameters to other systems. Borehole 110 is surrounded by subterranean formation 150.

Well site controller 107 or computing system 108 which can be communicatively coupled to well site controller 107, can be utilized to communicate with downhole tools 120, such as sending and receiving telemetry, data, drilling sensor data, instructions, and other information, including hole cleaning parameters, such as the distance interval between calculations, weighting parameters, location within the borehole, a cuttings density, a cuttings load, a cuttings shape, a cuttings size, a deviation, a drill pipe rotation rate, a drill pipe size, a flow regime, a hole size, a mud density, a mud rheology, a mud velocity, a pipe eccentricity, and other input parameters.

Computing system 108 can be proximate well site controller 107 or be a distance away, such as in a cloud environment, a data center, a lab, or a corporate office. Computing system 108 can be a laptop, smartphone, PDA, server, desktop computer, cloud computing system, other computing systems, or a combination thereof, that are operable to perform the processes and methods described herein. Well site operators, engineers, and other personnel can send and receive data, instructions, measurements, and other information by various conventional means with computing system 108 or well site controller 107.

In some aspects, a hole cleaning processor can be part of well site controller 107 or computing system 108. The hole cleaning processor can receive the various input parameters, such as from a data source, previous survey data, real-time or near real-time data received from sensors downhole or at a surface location, and perform the methods and processes disclosed herein. The results of the calculations can be communicated to a friction factor processor, a drilling operations system, a geo-steering system, or other well site system or user where the results can be used as inputs to direct further borehole operations. In some aspects, computing system 108 can be located with downhole tools 120 and the computations can be completed at the downhole location. The results can be communicated to a drilling system or to a drilling operation system downhole or at a surface location.

FIG. 1 depicts an onshore operation. Those skilled in the art will understand that the disclosure is equally well suited for use in offshore operations. FIG. 1 depicts a specific borehole configuration, those skilled in the art will understand that the disclosure is equally well suited for use in boreholes having other orientations including vertical boreholes, horizontal boreholes, slanted boreholes, multilateral boreholes, and other borehole types.

Figure 2:
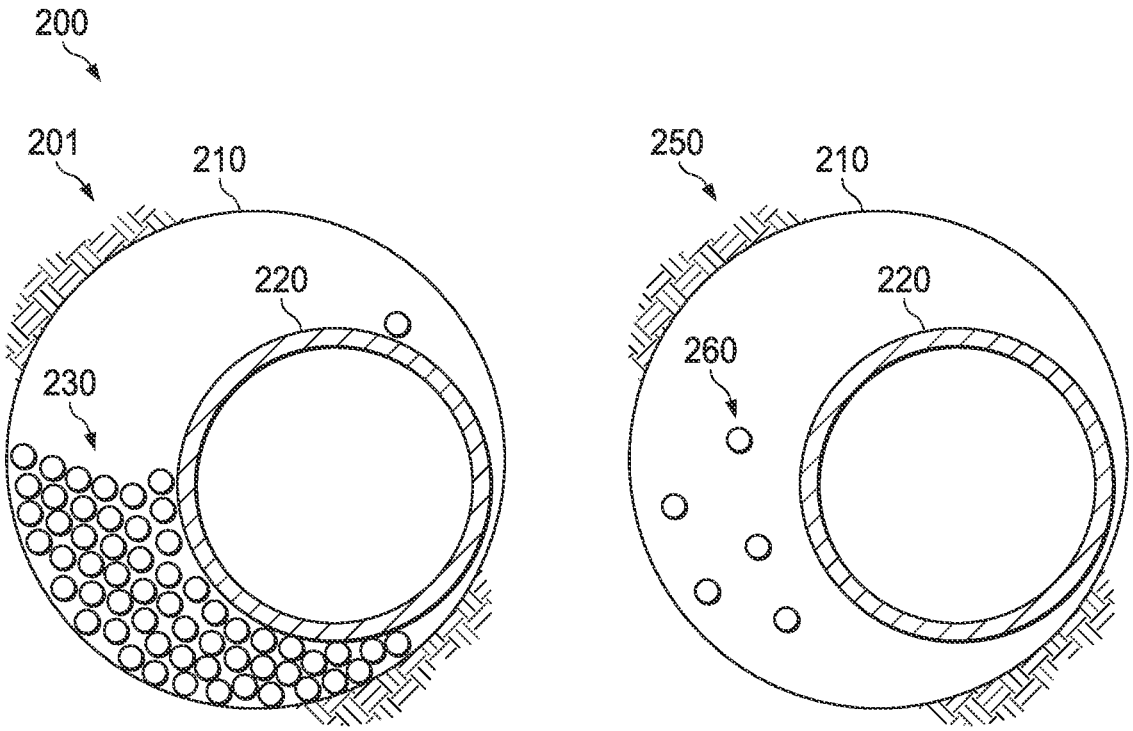
FIG. 2 is an illustration of diagrams of an example borehole system with cuttings and a drill string.

FIG. 2 is an illustration of diagrams of an example borehole system 200 with cuttings and a drill string. As drilling operations progress, cuttings can settle around the drill string. A borehole diagram 201 has a borehole 210 where inserted within is a drill string 220. Cuttings 230 are shown building up around drill string 220. A borehole diagram 250 is the same borehole after a hole cleaning operation has been performed. Cuttings 260 are significantly reduced as compared to cuttings 230. The hole cleaning parameters relating to the cuttings can be determined downhole, such as using a sensor, for example, an x-ray sensor, or at an uphole or surface location.

Figure 3:
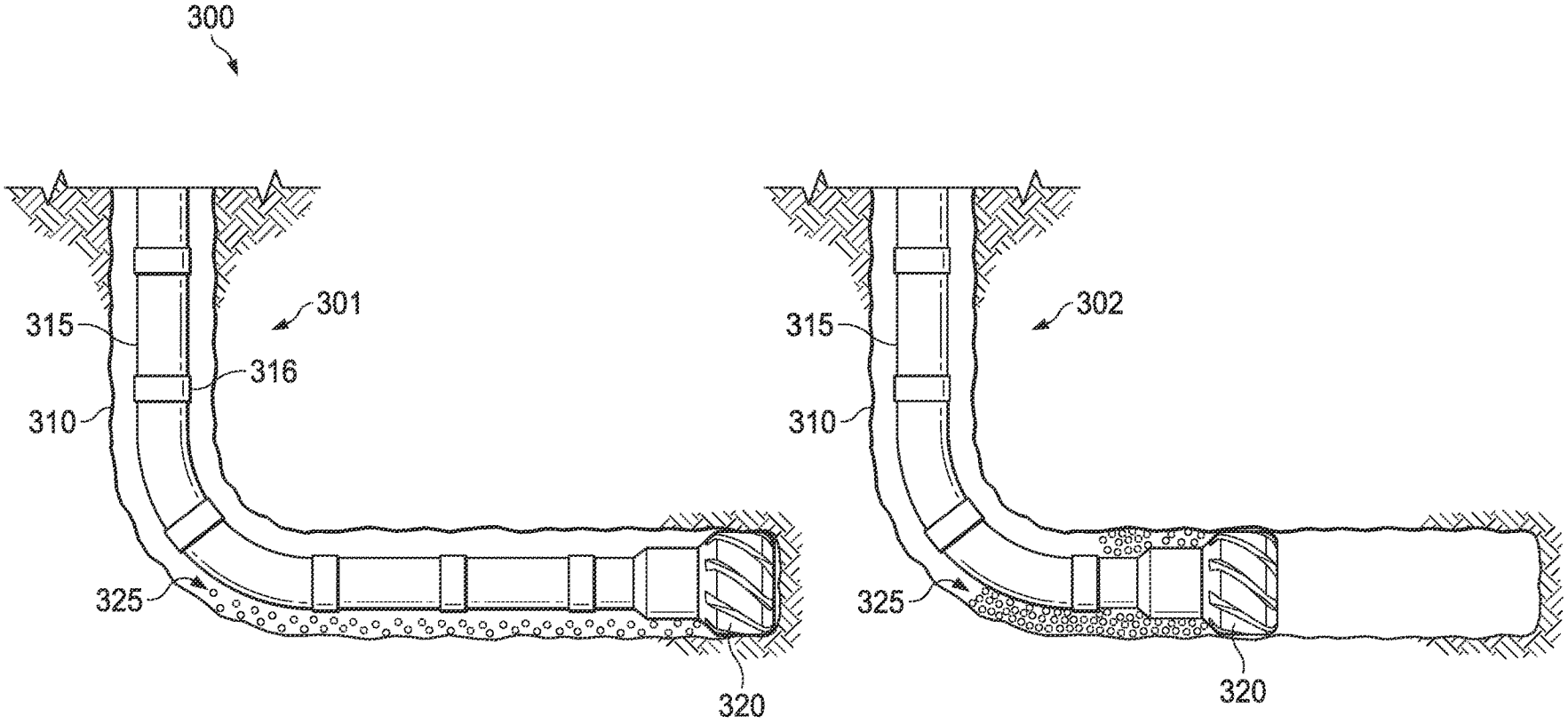
FIG. 3 is an illustration of diagrams of an example drill string trip out operation.

FIG. 3 is an illustration of a diagram of an example drill string trip out operation 300 demonstrating issues with poor hole cleaning. Drill string trip out operation 300 has a diagram 301 showing a first state of a borehole 310 with a drill string 315 inserted into borehole 310. Drill string 315 has drill string joints 316 and a drill bit assembly 320 at the end of drill string 315. Cuttings 325 have settled along a horizontal portion of borehole 310.

A diagram 302 shows borehole 310 after the drill string trip out operation has begun. Cuttings 325 have now collected behind drill bit assembly 320 and could cause an increase on the drag or torque friction factors. The increase of drag and torque can cause inefficiencies of the borehole operation, increase wear and tear on the machinery and components of the overall borehole system, or in severe cases, can cause the drill string to become stuck.

Figure 4:
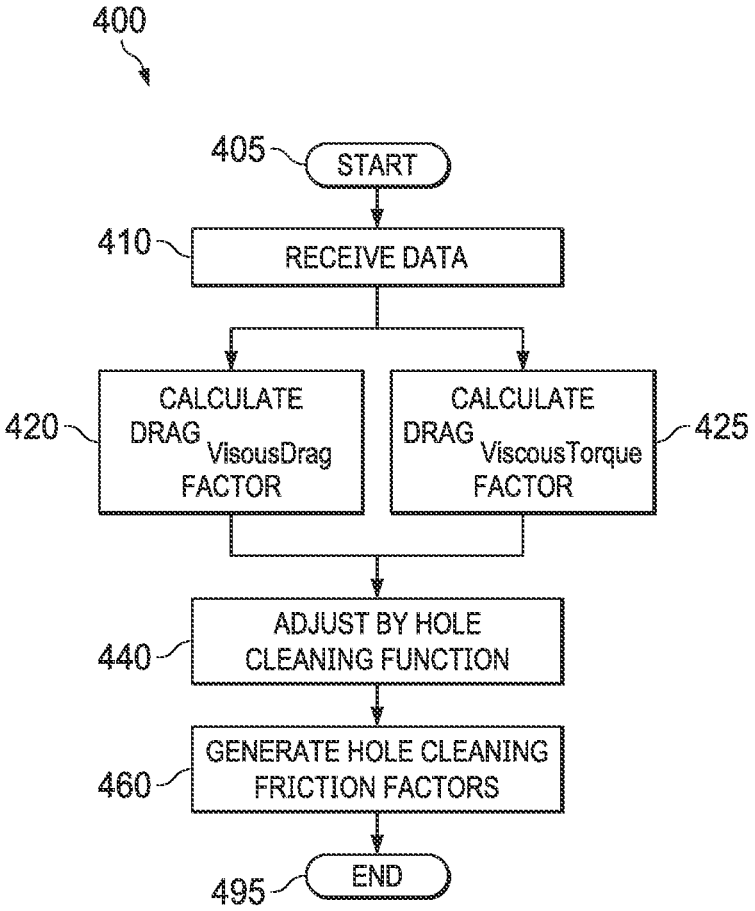
FIG. 4 is an illustration of a flow diagram of an example method for determining hole cleaning effects on hole cleaning friction factors.

FIG. 4 is an illustration of a flow diagram of an example method 400 for determining hole cleaning effects on hole cleaning friction factors. Method 400 can be performed on a computing system, such as a well site controller, a geo-steering system, a BHA, or other computing system capable of receiving the various survey parameters and inputs, and capable of communicating with equipment or a user at a borehole site. Other computing systems can be a smartphone, PDA, laptop computer, desktop computer, server, data center, cloud environment, or other computing system. Method 400 can be encapsulated in software code or in hardware, for example, an application, code library, dynamic link library, module, function, RAM, ROM, and other software and hardware implementations. The software can be stored in a file, database, or other computing system storage mechanism. Method 400 can be partially implemented in software and partially in hardware. Method 400 can perform the operations within the computing system or, in some aspects, generate a visual component, for example, a chart or graph showing the decomposed friction factors overlaid with a weighted distribution curve.

Method 400 starts at a step 405 and proceeds to a step 410. In step 410, data can be received, such as drilling sensor data, where the data can be pre-existing hole cleaning factors, hole cleaning factors from a data source, hole cleaning factors derived from real-time or near real-time measurements collected from sensors at a downhole or at a surface location, and other input parameters, for example, a weight distribution model, a type of borehole operation, a distance interval (such as every 40 feet) for performing the method, and other input parameters. Method 400 can be performed for more than one type of borehole operation and the results can be communicated separately or combined.

The hole cleaning factors can include, but are not limited to, a cuttings density, a cuttings load, a cuttings shape, a cuttings size, a deviation, a drill pipe rotation rate, a drill pipe size, a flow regime, a hole size, a mud density, a mud rheology, a mud velocity, a pipe eccentricity, and other parameters. The data source can be one or more various data sources, such as a well site controller, a server, laptop, PDA, desktop computer, database, file store, cloud storage, data center, or other types of data stores, and be located downhole, at a surface location, proximate the borehole, a distance from the borehole, in a lab, an office, a data center, or a cloud environment.

From step 410, method 400 proceeds to one or more of a step 420, or a step 425, where each of these steps can be performed serially, in parallel, partially overlapping, or various combinations thereof. The steps selected for performance can vary according to the borehole operation. For example, a trip out of a drill string can utilize a different set of hole cleaning factors than a drilling operation.

In some aspects, in step 420, the $\text{Drag}_{ViscousDrag}$ factor can be calculated from the received data from step 410 and analyzed. The $\text{Drag}_{ViscousDrag}$ can utilize various parameters, for example, a friction factor, a buoyed weight of drill pipe parameter, a velocity ratio parameter, and a viscous drag parameter. The $\text{Drag}_{ViscousDrag}$ factor can be calculated such as shown in Equation 1. In some aspects, in step 420, the friction factor for viscous drag can be calculated as shown in Equation 5.

In some aspects, in step 425, the $\text{Drag}_{ViscousTorque}$ factor can be calculated from the received data from step 410 and analyzed. The $\text{Drag}_{ViscousTorque}$ can utilize various parameters, for example, a friction factor, a buoyed weight of drill pipe parameter, a drill pipe radius, a velocity ratio parameter, and a viscous torque parameter. The $\text{Drag}_{ViscousTorque}$ factor can be calculated such as shown in Equation 2. In some aspects, in step 425, the friction factor for viscous torque can be calculated as shown in Equation 5.

Once the selected one or more steps of step 420 or step 425 have completed, method 400 proceeds to a step 440. In step 440, the $\text{Drag}_{ViscousDrag}$ or $\text{Drag}_{ViscousTorque}$ (collectively, $\text{Drag}_x$) parameter can be adjusted by a hole cleaning function. The hole cleaning function, for example, the functions shown in Equation 3 and Equation 4, can utilize one or more of the parameters received in step 410.

Method 400 proceeds to a step 460. In some aspects, the one or more hole cleaning adjusted $\text{Drag}_x$ parameters can be generated from the output of step 440. In some aspects, the one or more hole cleaning $\text{Drag}_x$ parameters can be utilized to generate decomposed hole cleaning friction factors. In various aspects, the generated results can be communicated to one or more other systems and used as input into other processes, for example, a borehole operation plan adjustment process, a well site controller, a drilling fluid composition system, a geo-steering system, a BHA, a drilling system, a user, or other computing system supporting the well site. In some aspects, the generated results can be used to calibrate an estimated friction coefficient for one or more portions of the borehole. Method 400 ends at a step 495.

Figure 5:
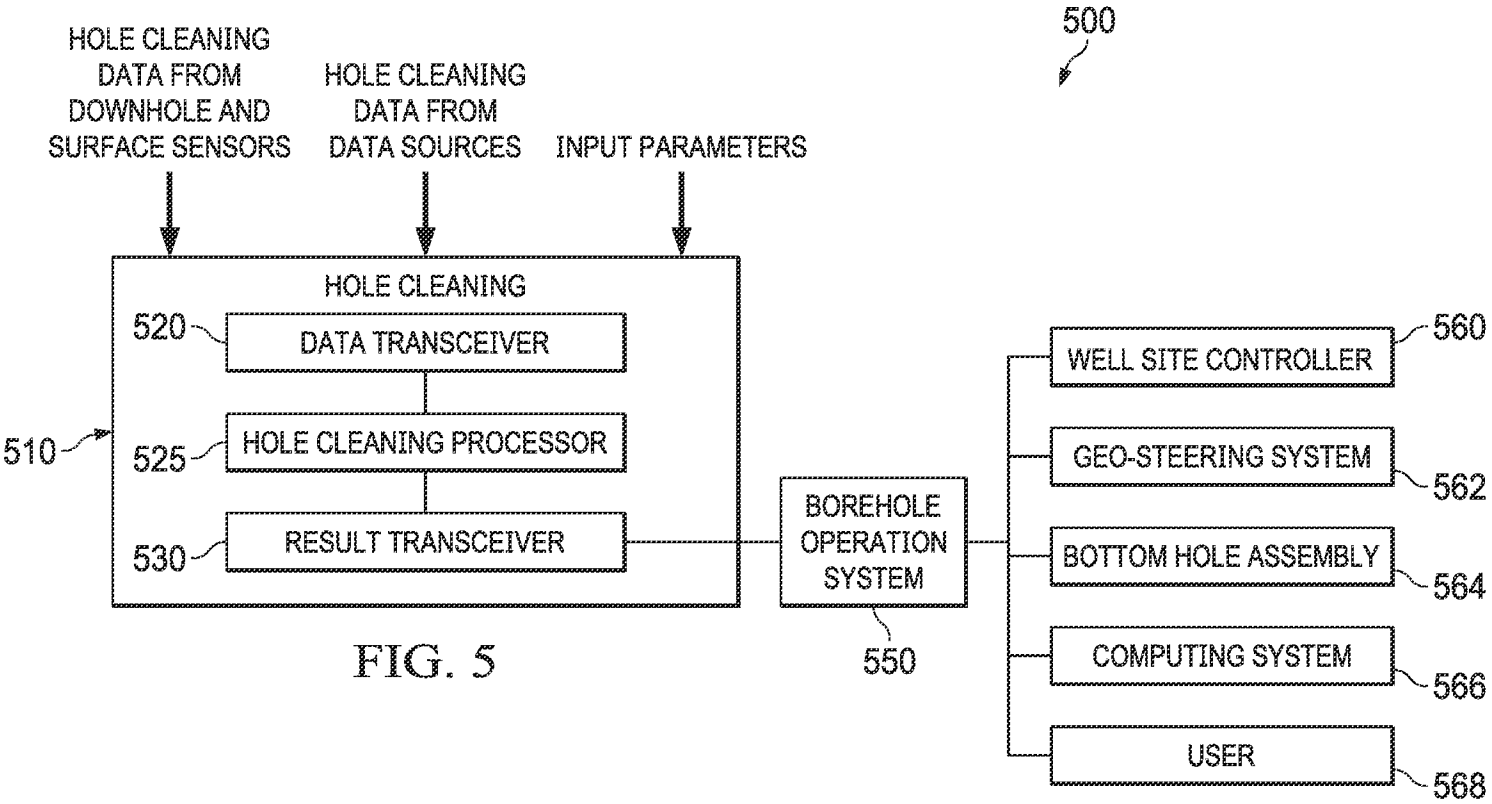
FIG. 5 is an illustration of a block diagram of an example hole cleaning processor.

FIG. 5 is an illustration of a block diagram of an example hole cleaning processing system 500, which can be implemented in one or more computing systems, for example, a well site controller, a reservoir controller, a data center, cloud environment, server, laptop, smartphone, tablet, and other computing systems. The computing system can be located downhole, proximate the well site, or a distance from the well site, such as in a data center, cloud environment, or corporate location. Hole cleaning processing system 500 can be implemented as an application, a code library, a dynamic link library, a function, module, other software implementation, or combinations thereof. In some aspects, hole cleaning processing system 500 can be implemented in hardware, such as a ROM, a graphics processing unit, or other hardware implementation. In some aspects, hole cleaning processing system 500 can be implemented partially as a software application and partially as a hardware implementation.

Hole cleaning processing system 500 includes a hole cleaning modeler 510 which further includes a data transceiver 520, a hole cleaning processor 525, and a result transceiver 530. Data transceiver 520 can receive input parameters, real-time or near real-time hole cleaning factors from one or more of downhole sensors or surface sensors (such as drilling sensor data), hole cleaning factors from previous survey data, and hole cleaning factors from a data store. Data transceiver 520 is capable of receiving hole cleaning parameters for one or more portions of the borehole.

The input parameters can be parameters, instructions, directions, data, and other information to enable or direct the remaining processing of hole cleaning processing system 500. For example, the input parameters can include a weight distribution model, a distance interval for performing the methods and processes, a type of borehole operation, hole cleaning parameters, and other input parameters. The data store can be one or more data stores, such as a database, a data file, a memory, a server, a laptop, a server, a data center, a cloud environment, or other types of data stores located proximate hole cleaning modeler 510 or a distance from hole cleaning modeler 510.

Data transceiver 520 can receive the data and parameters from one or more sensors located proximate the drilling system or located elsewhere in the borehole or at a surface location. In some aspects, data transceiver 520 can receive various data from a computing system, for example, when a controller or computing system collects the data from the sensors and then communicates the data to data transceiver 520. The measurements collected by the sensors can be transformed into hole cleaning parameters by the sensors, data transceiver 520, or another computing system.

Result transceiver 530 can communicate one or more calculated results, e.g., result parameters, to one or more other systems, such as a geo-steering system, a geo-steering controller, a well site controller, a computing system, a BHA, drilling system, a user, or other borehole related systems. Other borehole related systems can include a computing system where hole cleaning modeler 510 is executing or be located in another computing system proximate or a distance from hole cleaning modeler 510. Data transceiver 520 and result transceiver 530 can be, or can include, conventional interfaces configured for transmitting and receiving data. In some aspects, data transceiver 520 and result transceiver 530 can be combined into one transceiver. In some aspects, data transceiver 520, hole cleaning processor 525, and result transceiver 530 can be combined into one component.

Hole cleaning processor 525 can implement the methods, processes, analysis, equations, and algorithms as described herein utilizing the received data and input parameters to determine, in some aspects, a generated decomposed hole cleaning friction factor. In some aspects, hole cleaning processor 525 can determine an adjusted drag factor utilizing viscous drag or an adjusted drag factor utilizing viscous torque. In some aspects, hole cleaning processor 525 can use one or more algorithms, such as machine learning, decision tree, random forest, logistic regression, linear, stochastic, and other statistical algorithms. In some aspects, hole cleaning processor 525 can utilize a weight distribution model to ascertain whether a hole cleaning factor exceeds a deviation threshold along a portion of the distance interval. In some aspects, the weight distribution deviation threshold and the portion of the hole cleaning factor falling outside of the deviation threshold can be communicated as part of the results to other borehole systems.

In some aspects, hole cleaning processor 525 can identify an outlier portion of the one or more hole cleaning friction factors using the input parameters, wherein the input parameters include a deviation threshold. The outlier portion can be a portion of the data that exceeds the deviation threshold, such as exceeding a standard deviation amount. In some aspects the cause for that outlier portion can be identified and used for calibration. In some aspects, hole cleaning processor 525 can calibrate an estimated friction factor using the outlier portion and the identified cause of that outlier portion.

A memory or data storage of hole cleaning processor 525 or hole cleaning modeler 510 can be configured to store the processes and algorithms for directing the operation of hole cleaning processor 525.

The results from hole cleaning modeler 510 can be communicated to another system, such as a borehole operation system 550. Borehole operation system 550 can be one or more of a well site controller 560, a geo-steering system 562, a BHA 564, a computing system 566, or a user 568. The results can be used to direct the borehole operation system 550 in improving the efficiency of the borehole operation, such as adjusting the borehole operation plan.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

What is claimed is:

1. A method to determine a hole cleaning friction factor for a borehole operation, comprising:

receiving drilling sensor data, wherein the drilling sensor data includes input parameters and hole cleaning parameters related to cuttings resulting from drilling including at least one of a cuttings density, a cuttings load, a cuttings shape, and a cuttings size;

calculating a drag factor using the drilling sensor data;

generating one or more hole cleaning friction factors utilizing the drag factor and the drilling sensor data, wherein the hole cleaning friction factor applies to a portion of a borehole undergoing the borehole operation, and the drag factor is adjusted by a hole cleaning function;

communicating the one or more hole cleaning friction factors to a system of the borehole operation; and adjusting the borehole operation based on the one or more hole cleaning friction factors.

2. The method as recited in claim 1, further comprising:

communicating the one or more hole cleaning friction factors to another system of the borehole; and adjusting a borehole operation plan of the borehole using the one or more hole cleaning friction factors.

3. The method as recited in claim 2, wherein the adjusting further comprises:

identifying an outlier portion of the one or more hole cleaning friction factors using the input parameters, wherein the input parameters include a deviation threshold; and calibrating an estimated friction factor using the outlier portion.

4. The method as recited in claim 1, wherein the hole cleaning parameters further include a deviation, a drill pipe rotation rate, a drill pipe size, a flow regime, a hole size, a mud density, a mud rheology, a mud velocity, or a pipe eccentricity.

5. The method as recited in claim 4, wherein there is more than one type of cutting and each type of cutting has a separate set of hole cleaning parameters.

6. The method as recited in claim 1, wherein the drag factor is calculated using a viscous drag parameter.

7. The method as recited in claim 1, wherein the drag factor is calculated using a viscous torque parameter.

8. The method as recited in claim 1, wherein the drilling sensor data is received from one or more of a downhole sensor, a surface sensor, a data store, a well site controller, or a computing system.

9. The method as recited in claim 1, wherein the one or more hole cleaning friction factors is one or more of a viscous drag factor, a torque drag factor, a viscous drag decomposed friction factor, or a viscous torque decomposed friction factor.

10. The method as recited in claim 1, wherein the method is performed for more than one borehole operation as determined by the input parameters.

11. A system to adjust a borehole operation utilizing a hole cleaning friction factor, comprising:

a data transceiver, capable of receiving input parameters, drilling sensor data, and hole cleaning parameters related to cuttings resulting from drilling from one or more of downhole sensors, surface sensors, a data store, a previous survey data, a well site controller, or a computing system, wherein the hole cleaning parameters related to cuttings resulting from drilling include at least one of a cuttings density, a cuttings load, a cuttings shape, and a cuttings size;

a result transceiver, capable of communicating a generated hole cleaning friction factor and one or more decomposed hole cleaning friction factors to a borehole operation system; and a hole cleaning processor, capable of using the hole cleaning parameters and the input parameters to generate one or more hole cleaning friction factors utilizing a hole cleaning function; wherein a borehole operation is adjusted based on the one or more hole cleaning friction factors.

12. The system as recited in claim 11, wherein the system is further capable of adjusting a borehole operation plan.

13. The system as recited in claim 11, wherein the system is one or more of the well site controller, a geo-steering system, a bottom hole assembly, or the computing system.

14. The system as recited in claim 11, wherein the hole cleaning processor is further capable of identifying a portion of the one or more hole cleaning friction factors that exceed a deviation threshold, and wherein the result transceiver is further capable of communicating the portion of the one or more hole cleaning friction factors.

15. A computer program product having a series of operating instructions stored on a non-transitory computer-readable medium that directs a data processing apparatus when executed thereby to perform operations to determine a hole cleaning friction factor for a borehole operation, the operations comprising:

receiving drilling sensor data, wherein the drilling sensor data includes input parameters and hole cleaning parameters related to cuttings resulting from drilling including at least one of a cuttings density, a cuttings load, a cuttings shape, and a cuttings size;

calculating a drag factor using the drilling sensor data; and generating one or more hole cleaning friction factors utilizing the drag factor and the drilling sensor data, wherein the hole cleaning friction factor applies to a portion of a borehole undergoing the borehole operation, and the drag factor is adjusted by a hole cleaning function;

communicating the one or more hole cleaning friction factors to a system of the borehole operation; and adjusting the borehole operation based on the one or more cleaning friction factors.

16. The computer program product as recited in claim 15, further comprising:

communicating the one or more hole cleaning friction factors to another system of the borehole; and adjusting a borehole operation plan of the borehole using the one or more hole cleaning friction factors.

17. The computer program product as recited in claim 16, wherein the adjusting further comprises:

identifying an outlier portion of the one or more hole cleaning friction factors using the input parameters, wherein the input parameters include a deviation threshold; and calibrating an estimated friction factor using the outlier portion.

18. The computer program product as recited in claim 15, wherein the hole cleaning parameters further include a deviation, a drill pipe rotation rate, a drill pipe size, a flow regime, a hole size, a mud density, a mud rheology, a mud velocity, or a pipe eccentricity.

19. The computer program product as recited in claim 15, wherein the drag factor is calculated using one or more of a viscous drag parameter or a viscous torque parameter.

20. The computer program product as recited in claim 15, wherein the one or more hole cleaning friction factors is one or more of a viscous drag factor, a torque drag factor, a viscous drag decomposed friction factor, or a viscous torque decomposed friction factor.

* * * * *